US006054422A

United States Patent [19]

Ward et al.

[11] Patent Number: 6,054,422

[45] Date of Patent: Apr. 25, 2000

[54] CUTTING AND LUBRICATING COMPOSITION FOR USE WITH A WIRE CUTTING APPARATUS

[75] Inventors: Irl E. Ward, Bethlehem; Phuong Tang, Easton, both of Pa.

[73] Assignee: PPT Research, Inc., Allentown, Pa.

[21] Appl. No.: 09/252,543

[22] Filed: Feb. 19, 1999

[51] Int. Cl.[7] ..... C10M 111/04; C10M 107/34

[52] U.S. Cl. ..... 508/579; 508/268; 508/154

[58] Field of Search ..... 508/579

[56] References Cited

U.S. PATENT DOCUMENTS

| | | | |
|---|---|---|---|
| 4,116,872 | 9/1978 | Jahnke | 252/32.7 E |
| 4,212,750 | 7/1980 | Gorman | 252/32.5 |
| 4,781,847 | 11/1988 | Weitz | 252/49.3 |
| 4,828,735 | 5/1989 | Minagawa et al. | 252/49.3 |
| 4,971,722 | 11/1990 | Philippsen | 252/315.1 |
| 5,349,149 | 9/1994 | Shiraki et al. | 219/69.14 |
| 5,415,896 | 5/1995 | Mulvihill et al. | 427/388.4 |
| 5,494,596 | 2/1996 | Law et al. | 252/54 |
| 5,559,087 | 9/1996 | Halsrud et al. | 508/579 |

*Primary Examiner*—Ellen M. McAvoy
*Attorney, Agent, or Firm*—John Lezdey & Assoc.

[57] ABSTRACT

A lubricating composition which may contain up to 70 weight percent abrasive grit material for use with wire saw and slicing apparatus for cutting or slicing hard and brittle materials. The composition contains abrasive particles suspended in a mixture of high and low molecular weight polyalkylene glycols and a suspension agent. The viscosity of the composition is about 50 to 700 cps.

23 Claims, No Drawings

CUTTING AND LUBRICATING COMPOSITION FOR USE WITH A WIRE CUTTING APPARATUS

BACKGROUND OF THE INVENTION

1. Field of the Invention

This invention relates to a novel cutting and lubricating composition for use with an apparatus for cutting workpieces of hard and brittle material such as semiconductor ingots of silicon, germanium, gallium arsenide, glass or other brittle materials, such as granite block, into a multiplicity of thin sheets, slices or wafers.

2. Description of the Prior Art

The cutting apparatus usually comprises a row of fine wires arranged parallel to each other and at a fixed pitch. A workpiece is pressed against these fine wires having diameters in the order of 0.2 millimeters running in parallel with one another in the same direction, while an abrasive fluid is supplied between the workpiece and the wires, thereby slicing the workpiece into wafers by a grinding action. Thus, the abrasive particles carried by the liquid are transferred to the cutting sections of the wires to produce a splitting or cutting effect. The above described splitting units or machines are described in U.S. Pat. Nos. 3,478,732, 3,525,324, 5,269,275 and 5,270,271, which are incorporated by reference.

The cutting apparatus may also comprise a series of wires inter-looped or entwined together in a braided loop configuration. This configuration can be used for the cutting of granite block or silicon ingots. The workpiece is pressed against the braided wire and the cutting process is augmented by the abrasive particles as described above.

Achieving an optimum cutting quality depends on a combination of parameters, i.e., the quality of the abrasive fluid and the force with which the workpiece is pressed against the set of cutting wires.

Effort is now being directed to optimizing the cutting quality obtained under mass production conditions. By cutting quality is meant exact planarity of the surfaces without taper and thickness variation to yield products suitable for semiconductor devices and solar cells. Mass production considerations, for example, the rate of wear of the wire, the effectiveness recovery and recycling of the cutting and lubricating fluids are also important. U.S. Pat. No. 5,099,820 issued to Stricot discloses an abrasive liquid as a suspension of particles of silicon carbide in water or oil. However, these prior art suspensions are not stable and do not provide uniform lubrication to the wires. Furthermore, these compositions require vigorous agitation to maintain uniform suspension of the particles, and the suspension settles out quickly under stagnant conditions.

There exists a need for a novel lubricating composition for cutting machines that has excellent lubricity and heat transfer properties. Thus, there also exits a need for a novel cutting and lubricating composition which provides a uniform supply of abrasive material so that the workpiece is more efficiently cut by the abrasive grit in the composition. Further, the composition should have excellent lubricity and heat transfer properties to remove the frictional heat generated at the cutting site thereby increasing working life of the wire and avoiding downtime. Finally, the composition should provide a stable suspension of abrasive particles. However, if stored for a long period and should separation occur, only a gentle agitation Would be required to restore the suspension.

SUMMARY OF THE INVENTION

According to the broadest aspect, the present invention relates to a cutting and lubricating composition for use with an apparatus for cutting workpieces of a hard and brittle material such as semiconductor materials, magnetic materials, ceramics, granite block solar energy components, and the like. More specifically, the lubricating composition of the present invention comprises:

a) from about 1 to 35 weight percent of a suspension agent;

b) from about 65 to 99 weight percent of a combination of polyalkylene glycols, wherein said alkylene group contains 2 to 5 carbon atoms;

wherein the combination of glycols consists of from about 65 to 99 weight percent of a glycol having a number average molecular weight of about 300 to 600 and about 1 to 35 weight percent of a glycol having an average molecular weight of about 1000 to 5000; and wherein the viscosity of the composition ranges from about 50 to 700 cps, and whereby the lubricating composition is water soluble and/or water miscible.

Preferably, the glycols are selected from the group consisting of polyethylene glycol, polypropylene glycol, polyisobutylene glycol, and the coglycols thereof;

Suspension agents encompass polar solvents, surfactants and thickeners. Useful polar solvents are selected from alcohol, amides, lactams, esters, ketones, glycol ethers, basic amines or sulfoxides. Suitable surfactants include any anionic, cationic and/or nonionic surfactants. Examples of suitable thickeners include carboxylmethylcellulose, methylcellulose, polyacrylic acid, starches and polysaccharides.

A preferred lubricating composition comprises:

a) from about 5 to 15 weight percent of a suspension agent;

b) from about 15 to 95 weight percent of a combination of polyethylene glycols;

wherein said combination of polyethylene glycols consist of from about 80 to 92 weight percent a polyethylene glycol having a number average molecular weight of about 300 to 500, and about 1 to 6 weight percent of a polyethylene glycol having a number average molecular weight of about 1000 to 2000; and whereby the viscosity ranges from about 50 to 700 cps.

Most preferably, according to the present invention is a lubricating composition which comprises:

a) about 6 to 10 weight percent of N-methyl pyrrolidone;

b) about 90 to 94 weight percent of a combination of polyethylene glycols wherein said polyethylene glycols consist of about 87 to 90 weight percent of a polyethylene glycol having a number average molecular weight of about 400 and about 3 to 5 weight percent of a polyethylene glycol having a number average molecular weight of about 1500; and whereby the viscosity of the composition is about 50 to 500 cps under room temperature conditions (25° C.).

The lubricating compositions of the present invention may also contain from about 1 to 70 weight percent abrasive particles to provide a cutting and lubricating composition for use with a machine for cutting workpieces of hard and brittle material. The abrasive particles are held in suspension by the lubricating composition and are transferred to the wire surfaces to produce a uniform cutting edge.

According to the present invention, the cutting and lubricating composition comprises:

A. from about 30 to 99 weight percent of a lubricating composition comprising
   a. from about 1 to 20 weight percent suspension agent; and
   b. from about 80 to 99 weight percent of a combination of polyalkylene glycol wherein the alkylene group consists of from 2 to 5 carbon atoms, wherein said combination consists of from about 80 to 92 weight of a glycol having an average number molecular weight of about 200 to 600 and about 1 to 35 weight percent of a glycol having an average number molecular weight of about 1,000 to 5,000; to which from about 1 to 70 weight percent of an abrasive particle is added; said composition having a viscosity of about 50 to 700 cps.

It is therefore a primary object of this invention to provide a lubricating composition for a multi-wire saw machine for cutting a hard and brittle material which increases production efficiency and quality of product.

It is another object of this invention to provide a cutting and lubricating composition which allows for the uniform distribution of the abrasive material to the cutting wire.

It is a further object of this invention to provide a lubricating composition which is fully water soluble, water miscible and of very low toxicity.

Yet another object of the invention is to provide a cutting and lubricating composition which has excellent heat exchange characteristics to transfer away heat of friction generated at the wire or braid and to ensure a long service for the cutting wire or braid.

A still further object is to provide high quality workpieces suitable for semiconductor and solar devices.

Other objects and a more complete understanding of the invention will be had by referring to the following description.

DETAILED DESCRIPTION OF THE PREFERRED EMBODIMENTS

According to the present invention, a novel cutting and/or lubricating composition increases the efficiency and productivity of abrasion-type splitting units for splitting ingots made of brittle and hard material providing quality components for semiconductor and photocell devices. The lubricating composition of this invention maintains abrasive particles in suspension to allow a more uniform delivery of these abrasive particles to the wedge-shaped spaces which are formed between the wire and the workpiece, alternatively, at both ends of the cutting portion, with the result that the accuracy and efficiency of the machinery are greatly improved. Also, the lubricating composition provides lubrication to the slicing wire and absorbs the frictional heat generated at the cutting surfaces. Thus, these features prolong the service life of the wire or braid and avoid any warping of the workpiece surfaces which deficiency cannot be tolerated in semiconductor or photocell devices.

A lubricating composition for use with a wire cutting apparatus of this invention comprises:

a) from about 1 to 35 weight percent of a suspension agent;

b) from about 65 to 99 weight percent of a glycol base consisting of a combination of polyalkylene glycols, wherein the alkylene substituent contains 2 to 5 carbon atoms; and wherein the viscosity of said composition ranges from about 50 to 700 cps.

In its broadest scope; the glycol base comprises a combination of from about 80 to 11 weight percent of a polyalkylene glycol having an average number molecular weight of about 200 to 600, most preferably about 400, and about 1 to 20 weight percent of a polyalkylene glycol having an average number molecular weight of about 1000 to 2000, most preferably about 1500. Preferably, the glycol base may comprise about 85 to 99 weight percent PEG 400 to 600 and about 1 to 15 weight percent PEG 1000 to 2000 and most preferably about 87 to 99 weight percent PEG 400 and about 1 to 13 weight percent PEG. 1500.

Suspension agents are selected from polar solvents, surfactants, thickening agents or mixtures thereof.

Polar solvents which are useful as suspension agents include alcohols, amides, lactams,esters, ethers, ketones, glycol ethers, basic amines or sulfoxides. Specifically, examples of polar solvents are dimethyl sulfoxide, dimethyl acetamide (DMAC), N-methyl pyrrolidone, (gamma) butyrolactone, di(ethylene glycol) ethyl ether, di(propylene glycol) methyl ether, tri(propylene glycol) monomethyl ether diethanol amine, aminoethoxyethanol, and the like. The amount of polar solvents used in the lubricating composition may range from about 1 to 35 weight percent and preferably about 3 to 10 weight percent.

The surfactants which can be used in the present compositions are the water soluble anionic, nonionic, ampholytic, zwitterionic or cationic surfactants.

Suitable anionic surface active agents include, for example, alkali metal salts of alkyl substituted benzene sulfonic acids, alkali metals salts of long chain fatty sulphates, alkali metal ether sulphates derived from alcohols and alkali phenols, alkali metal sulpho-succinates, alkali metal sarcosinates and alkali metal taurides. Suitable cationic surface active agents include quaternary ammonium bromides and chlorides containing a long chain alkyl group such as, for example, cetrimide or benzalkonium chloride. Suitable amphoteric surface active agents include so called "betaine" type and imidazoline type surface active agents.

Preferred anionic surfactants include alkyl dimethylamine oxides having 12 to 25 carbon atoms such as N,N-dimethyl-1-tetradecanamine oxide and N,N-dimethyl-1-octadecananime oxide, sodium lauroyl sarcosinate, diphenyl ether sulfonates such as the alkali metals salts of hexadecyl diphenyl ether disulfonic acid, dodecyl diphenyl ether disulfonic and decyl diphenyl ether disulfonic acid, preferably $C_{10}$–$C_{18}$ alkylbenzene sulfonates. Commercially available anionic surfactants which may be used include mixtures of $C_{10}$–$C_{13}$ linear sodium alkylbenzene sulfonate marketed by De Soto or Stepan Corporation (a $C_{11.7}$ linear alkybenzene sulfonate). Calsoft F90 of Pilot Corporation (a $C_{10}$–$C_{13}$ sodium linear alkylaryl sulfonate), Witconate 90F of Witco Corporation (a $C_{12}$ sodium alkylaryl sulfonate containing 1.7% free oil and 3.0% $SO_4$), Nansa HS 80PF of Albright & Wilson Ltd. and Stepan Agent S-1509-65 of Stepan Corporation (a $C_{13}$ calcium dodecylbenzene sulfonate) are also suitable.

Nonionic surfactants which can be used in practicing the present invention can be of three basic types—the alkaline oxide condensates, the amides and the semi-polar nonionics.

The alkaline oxide condensates are broadly defined as compounds produced by the condensation of alkaline oxide groups (hydrophilic in nature) with an organic hydrophobic compound, which can be aliphatic or alkyl aromatic in nature. The length of the hydrophilic or polyoxyaklylene radical which is condensed with any particular hydrophobic group can be readily adjusted to yield a water soluble compound having the desired degree of balance between hydrophilic and hydrophobic elements.

Examples of such alkaline oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol and the condensation product of about 9 moles of ethylene oxide with the above described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by The Proctor & Gamble Company.

2. The condensation products of ethylene oxide with a hydrophobic based formed by the condensation of propylene oxide with propylene glycol. The hydrophobic portion of these compounds has a molecular weight of from about 1500 to 1800 and of course exhibits water insolubility. The addition of polyoxyethylene moieties of this hydrophobic portion tends to increase the water solubility of the molecule. Examples of compounds of this type include certain of the commercially available Pluronic surfactants marketed by the Wyandotte Chemicals Corporation.

3. The condensation products of ethylene oxide with the product resulting from the reaction of propylene oxide and ethylene diamine. The hydrophobic based of these products consists of the reaction product of ethylene diamine and excess propylene oxide, said based having a molecular weight of from about 2500 to about 3000. This base is condensed with ethylene oxide to the extent that the condensation product contains from about 40% to about 80% weight of polyoxyethylene and has a molecular weight of from about 5.000 to about 11.000. Examples of this type of nonionic surfactant include certain of the commercially available Tetronic compounds marketed by the Wyandotte Chemicals Corporation.

Examples of the amide type of nonionic surfactants include the ammonia, monoethanol and diethanol amides of fatty acids having an acyl moieties of from about 8 to about 18 carbon atoms. These acyl moieties are normally derived from naturally occurring glycerides, e.g. coconut oil, palm oil, soybean oil and tallow, but can be derived synthetically, e.g. by the oxidation of petroleum, or by hydrogenation of carbon monoxide by the Fischer-Tropsch process.

Examples of the semi-polar type of nonionic surfactants are the amine oxides, phosphine oxides and sulfoxides. These materials are described more fully in U.S. Pat. No. 3,819,528, Berry, issued Jun. 25, 1974, and incorporated herein by reference.

Ampholytic surfactants which can be used in practicing the present invention can be broadly described as derivatives of aliphatic amines which contain a long chain of about 8 to about 18 carbon atoms and an anionic water-solubilizing group, e.g. carboxyl, sulfo and sulfato. Examples of compounds falling within this definition are sodium 3-dodecylamino-propionate, sodium-3-dodecylamino propane sulfonate, and dodecyl dimethylammonium hexanoate.

Zwitterionic surfactants which can be used in practicing the present invention are broadly described as internally-neutralized derivatives of aliphatic quaternary ammonium and phosphonium and tertiary sulfonium compounds, in which the aliphatic radical can be straight chain or branched, and wherein one of the aliphatic substituents contains from about 8 to about 18 carbon atoms and one contains an anionic water solubilitizing group, e.g., carboxyl, sulfo, sulfato, phosphate, or phosphono.

Cationic surfactants which can be used in practicing the present invention include stearyl dimethyl benzyl ammonium chloride, coconut dimethyl benzyl ammonium chloride, cetyl pyridinium chloride, and cetyl trimethyl ammonium chloride.

Particularly, preferred surfactants for use herein are sodium and potassium alkyl naphthalene sulfonates having one or two alkyl group containing about 1 to about 6 carbons each, and paraffin sulfonates having the formula $RSO_3M$, wherein R is a primary or secondary alkyl group containing from about 8 to about 22 carbon atoms (preferably about 12 carbon atoms), and M is an alkali metal.

The coglycols which can be used in the invention are commercially available from Aldrich Chemical Company.

Advantageously, thickening agents may also be added to the lubricating composition maintaining a constant viscosity and stability of the lubricant for dispersion over a wide temperature range, and for reducing the separation of the abrasive particle material when it is incorporated to form the cutting composition. Typical thickening agents include polysaccharides, polysaccharide derivatives, alkylcellulose, and polyacrylic acids, and alkali metal salts of polyacrylic acids. Suitable examples include xanthan gum, rhamsan gum, hydroxymethylcellulose, carboxymethylcellulose, starches, and sodium polyacrylate.

To form the cutting and lubricating composition according to this invention, an abrasive particle material is added to the lubricating composition with vigorous agitation until the abrasive particles are in suspension.

The abrasive particle material suitable for use in the above described lubricating composition to form the cutting and lubricating composition for wire cutting machines may include alumina powders, diamond, silica, tungsten carbide, silicon carbide, boron carbide or other hard abrasive materials. One of the preferred abrasive particle materials is silicon carbide. Generally, particle sizes range from about 1 to 500 microns; and preferably from 10 to 100 microns, and most preferably from 10 to 50 microns. The concentrations of the abrasive material in the lubricating composition medium ranges from about 1 to 70 weight percent, preferably about 25 to 60 weight and most preferably about 50 weight percent, based on the total composition.

The suspensions, according to the invention, are relatively stable. In many cases, even after long storage, it is unnecessary to agitate the abrasive particles before application to the wire cutting machine. However, if there is separation of the suspension, only mild agitation is required to restore the particles into uniform suspension. Usually, the action of the pump or spray to supply the cutting machine is sufficient to provide the necessary agitation following some initial recirculation.

The following examples are illustrative of the practice of the method of the present invention. It will be understood, however, that is not to be construed in any way limitative of the full scope of the invention since various changes can be made without departing from the spirit of the teachings contained herein in light of the guiding principles which have been set forth above. All percentages stated herein are based on weight except where otherwise indicated. The molecular weight referred to in this specification is number average molecular weight.

EXAMPLE 1

A polyethylene glycol base was prepared by adding 1.6 grams (4%) PEG-1500 to 38.4 grams (96%) PEG-400 in a glass beaker and heating at low heat (setting #1 on a Fischer Hot Plate) with medium stirring until the mixture was clear. The mixture was then cooled.

To 37.0 grams (92.5%) of the PEG base was added 3.00 grams (7.5%) N-methyl pyrrolidone to form the lubricating composition. The average viscosity measured by a Brookfield LVT viscometer #2 spindle at room temperature was about 300 cps.

Surfactants and/or thickening agents can be added to maintain a viscosity of about 50 to 700 cps.

EXAMPLE 2

To the lubricating base composition of Example 1 is added 7.06 grams (15%) silicon carbide having an average particle size distribution of about 10 to 30 microns to a glass beaker. A stir bar was placed into the mixture on a stirring plate at a fast speed for over 5 minutes until all the silicon carbide particles were in suspension.

The procedures of Example 1 and 2 was repeated in preparing Examples 3–24, which formulations are shown in TABLE I below.

TABLE I

| Example | % PEG 400 | % PEG 1500 | SUSPENSION AGENTS | | SILICON CARBIDE % (BASED ON TOTAL FORMULATION WT.) |
|---|---|---|---|---|---|
| | | | Solvents (7.5%) | | |
| 3 | 88.8 | 3.70 | NMP | | 15 |
| 4 | 88.8 | 3.70 | NMP | | 50 |
| 5 | 88.8 | 3.70 | GBL | | 15 |
| 6 | 88.8 | 3.70 | DEGEE | | 15 |
| 7 | 88.8 | 3.70 | DPGME | | 15 |
| 8 | 88.8 | 3.70 | TPGEE | | 15 |
| 9 | 88.8 | 3.70 | DMAC | | 15 |
| 10 | 88.8 | 3.70 | DMSO | | 15 |
| 11 | 90.65 | 1.85 | NMP | | 15 |
| 12 | 89.73 | 2.77 | NMP | | 15 |
| 13 | 88.8 | 3.70 | NMP | | 15 |
| 14 | 88.8 | 3.70 | NMP | | 15 |
| 15 | 88.8 | 3.70 | NMP | | 15 |
| 16 | 88.8 | 3.70 | DEA | | 15 |
| | | | THICKENER % T-5000 | | |
| 17 | 95.86 | 1.50 | 1.67 | | 15 |
| 18 | 96.00 | 1.50 | 2.50 | | 15 |
| | | | SURFACTANT % | | |
| 19 | 98.5 | 1.50 | ORCO-B-1 | 1.0 | 50 |
| 20 | 98.5 | 1.00 | FC-170 | 0.5 | 20 |
| 21 | 97.5 | 2.00 | FC-170 | 0.5 | 20 |
| 22 | 95.06 | 1.94 | A | 3.0 | 15 |
| 23 | 95.06 | 1.94 | B | 3.0 | 15 |
| 24 | 95.06 | 1.94 | C | 3.0 | 15 |
| 25 | 95.06 | 1.94 | D | 3.0 | 15 |

| Solvents | Surfactants |
|---|---|
| NMP = methyl pyrrolidone | A = AMAK 1225 & 1689 (5:1) |
| DMSO = dimethyl sulfoxide | B = AMAK 1225 & 1449 (5:1) |
| DMAC = dimethyl acetamide | C = AMAK 1689 |
| GBL = gamma butyrolactone | D = AMAK 1449 |
| DEGEE = di(ethylene glycol) ethyl ether | |
| DPGME = di(propylene glycol) methyl ether | |
| TPGEE = tri(propylene glycol) monoethyl ether | |

TABLE I-continued

| |
|---|
| DEA = diethanol amine |
| AMAK = Akzo Nobel Co. |
| ORCO |
| FC-170 = 3M Co. |
| T 5000 = Rohm & Haas Co. |

TABLE II below gives viscosity measurements for various mixtures of the PEG base of the lubrication compositions of the present invention. All the lubricating compositions (i.e., without added silicon carbide) contain 7.5 weight percent N-methyl pyrrolidone. To the lubricating 15 weight percent silicon carbide (based on total composition weight) having an average particle size of about 15 microns is added. Viscosity measurements were made with a Brookfield LVT Viscometer with a #2 spindle at the temperatures indicated in the table.

TABLE II

| Example | % PEG 400 | MOLECULAR WT. ADDED PEG | % ADDED PEG | VISCOSITY (cps) at RT |
|---|---|---|---|---|
| 26 | 96.30 | 1500 | 3.70 | 629 |
| 27 | 97.24 | 1500 | 2.76 | 499 |
| 28 | 97.46 | 1500 | 2.54 | 495 |
| 29 | 97.69 | 1500 | 2.31 | 456 |
| | | | | VISCOSITY at 25° C. |
| 30 | 96.30 | 1450 | 3.70 | 243 |
| 31 | 97.22 | 1450 | 2.78 | 208 |
| 32 | 97.69 | 1450 | 2.31 | 104 |
| 33 | 98.15 | 1450 | 1.85 | 76 |
| 34 | 98.61 | 1450 | 1.39 | 74 |
| 35 | 99.07 | 1450 | 0.93 | 70 |
| 36 | 96.30 | 1500 | 3.70 | 480 |
| 37 | 97.22 | 1500 | 2.78 | 346 |
| 38 | 97.46 | 1500 | 2.54 | 214 |
| 39 | 97.69 | 1500 | 2.31 | 263 |
| 40 | 98.38 | 2000 | 1.62 | 213 |
| 41 | 98.61 | 2000 | 1.39 | 193 |
| 42 | 99.91 | 2000 | 0.93 | 137 |
| 43 | 99.54 | 2000 | 0.46 | 63 |

The above formulations show high load-carrying capacities within the viscosity ranges recited. Thus, providing relatively stable suspensions.

What is claimed is:

1. A lubricating composition for use with a wire cutting apparatus comprising:

a) from about 1 to 35 weight percent suspension agent;

b) from about 65 to 99 weight percent of a combination of polyalkylene glycols wherein the alkylene substituent consists of 2 to 5 carbon atoms; and wherein said combination consists of from about 80 to 92 weight percent of a glycol having an average number molecular weight of about 200 to 600 and about 1 to 35 weight percent of a glycol having an average molecular weight of about 1000 to 5000, said composition having a viscosity of about 50 to 700 cps.

2. The composition of claim 1 wherein said suspension agent is selected from polar solvents, surfactants or thickening agents or mixtures thereof.

3. The composition of claim 2 wherein said polar solvent is selected from alcohols, amides, lactams, esters, ethers, ketones, lactones, glycol ethers, basic amines or sulfoxides or mixtures thereof.

4. The composition of claim 3 wherein said lactam is N-methyl pyrrolidone.

5. The composition of claim 3 wherein said glycol ethers are selected from di(methylene glycol) ethyl ether, di(propylene glycol) methyl ether or tri(propylene glycol) monomethyl ether.

6. The composition of claim 3 wherein said sulfoxide is dimethylsulfoxide.

7. The composition of claim 6 wherein said polar solvent is present in an amount of up to 10 percent by weight.

8. The composition of claim 2 wherein said surfactant is selected from anionic, cationic or non-ionic surfactants.

9. The composition of claim 8 wherein said surfactant is present in an amount of from about 0.1 to 10 weight percent.

10. The composition of claim 2 wherein said thickening agent is selected from polysaccharide, alkyl cellulose, carboxymethylcellulose, starches and polyacrylic acid.

11. The composition of claim 2 wherein said thickening agent is present in an amount of up to about 10 percent by weight.

12. The composition of claim 1 wherein said polyalkylene glycols are selected from the group consisting of polyethylene glycol, polypropylene glycol, polyisobutylene glycol and the glycols thereof.

13. The composition of claim 12 wherein said polyalkylene glycols are polyethylene glycol.

14. A lubricating composition comprising:

a) from about 0 to 10 weight percent of a non-ionic surfactant;

b) from about 1 to 20 weight percent of N-methyl pyrrolidone;

c) from about 80 to 99 weight percent of a combination of polyethylene glycols;

wherein said combination of polyethylene glycols consists of from about 87 to 90 weight percent of a polyethylene glycol having an average molecular weight of about 300 to 500 and 2 to 5 weight percent of a polyethylene glycol having an average molecular weight of about 1400 to 1600, said composition having a viscosity of about 50 to 700 cps.

15. The composition of claim 12 wherein said combination consist of from about 95 weight percent of a polyethylene glycol 400 and about 5 weight percent of polyethylene glycol 1500.

16. A cutting and lubricating composition comprising:

A. from about 30 to 99 weight percent of a lubricating composition comprising:

a. from about 1 to 20 weight percent suspension agent;

b. from about 80 to 99 weight percent of a combination of polyalkylene glycols wherein the alkylene group consists of from 2 to 5 carbon atoms, wherein said combination consists of from about 80 to 92 weight of a glycol having an average number molecular weight of about 200 to 600 and about 1 to 35 weight percent of a glycol having an average number molecular weight of about 1000 to 5000; and B. from about 1 to 70 weight percent of an abrasive particle material; said composition having a viscosity of about 50 to 700 cps.

17. The composition of claim 13 wherein said combination consists of from about 95 weight percent of a polyethylene glycol 400 and about 5 weight percent of polyethylene glycol 1500.

18. The composition of claim 16 wherein said abrasive particle material is selected from alumina, diamond, silica, boron carbide, silicon carbide or tungsen carbide.

19. The composition of claim 18 wherein said abrasive particle material is silicon carbide.

20. The composition of claim 18 wherein said abrasive particle material has a particle size ranging from 1 to 500 microns.

21. The lubricating composition of claim 16 further containing from about 1 to about 50 weight percent of said abrasive paarticle material.

22. A cutting and lubricating composition comprising:

a) about 15 weight percent silicon carbide;

b) about 6.5 weight percent N-methyl pyrrolidone;

c) about 78.5 weight percent of a combination of polyethylene glycols;

wherein said combination consists of about 86.5–91.5 weight percent of polyethylene glycol 400 and about 8.5–13.5 weight percent of polyethylene glycol 1500 having a viscosity of about 600 to 650 cps at room temperature.

23. In a method for wire cutting hard and brittle material the improvement which comprises cutting said material in a cutting and lubricating composition according to claim 14.

* * * * *